US012781648B2

(12) United States Patent
Sah et al.

(10) Patent No.: US 12,781,648 B2
(45) Date of Patent: Nov. 3, 2026

(54) ENGINE BRAKE HYDRAULIC CAPSULE WITH PLUNGER RETURN MECHANISM

(71) Applicant: Eaton Intelligent Power Limited, Dublin (IE)

(72) Inventors: Sumit Sah, Patna City (IN); Vikram Madhukar Deokar, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 19/288,588

(22) Filed: Aug. 1, 2025

(65) Prior Publication Data

US 2025/0361823 A1 Nov. 27, 2025

Related U.S. Application Data

(63) Continuation of application No. PCT/IB2024/052278, filed on Mar. 8, 2024.

(30) Foreign Application Priority Data

Mar. 9, 2023 (IN) ..... 202311015575

(51) Int. Cl.
*F01L 1/18* (2006.01)
*F01L 1/24* (2006.01)
(Continued)

(52) U.S. Cl.
CPC ..... *F01L 1/2416* (2013.01); *F01L 1/181* (2013.01); *F01L 1/26* (2013.01); *F01L 13/0005* (2013.01);
(Continued)

(58) Field of Classification Search
CPC ..... F01L 1/181; F01L 1/20; F01L 1/2416; F01L 1/26; F01L 1/267; F01L 13/0005;
(Continued)

(56) References Cited

U.S. PATENT DOCUMENTS 4,556,025 A * 12/1985 Morita ..... F01L 1/181 123/90.27
7,909,017 B2 * 3/2011 Yang ..... F01L 1/181 123/321

(Continued)

FOREIGN PATENT DOCUMENTS

WO WO 2017177102 A1 10/2017

OTHER PUBLICATIONS

International search report and Written Opinion received for PCT Application No. PCT/IB2024/052278, 14 pages, Jun. 7, 2024.

*Primary Examiner* — Dapinder Singh
(74) *Attorney, Agent, or Firm* — Meunier Carlin & Curfman LLC

(57) ABSTRACT

A rocker assembly for a valvetrain comprises a rocker arm comprising a cam end, a center pivot bore, and a valve end, the valve end comprising a first bore. The engine brake actuator comprises an engine brake mechanism disposed within the first bore, the engine brake mechanism comprising a body and a plunger disposed within the body. The plunger is configured to translate between a retracted position and an extended position. The plunger contains a spring disposed between latch pins, the spring being configured to bias the latch pins in an outward direction. The body defines seats for receiving the latch pins. The rocker assembly further comprising an actuation mechanism disposed within a second bore and configured to direct a fluid to the engine brake mechanism to hydraulically move the plunger to the extended position and hydraulically move the latch pins toward each other.

17 Claims, 7 Drawing Sheets

(51) Int. Cl.
*F01L 1/26* (2006.01)
*F01L 13/00* (2006.01)
*F01L 13/06* (2006.01)

(52) U.S. Cl.
CPC ..... *F01L 13/06* (2013.01); *F01L 2001/2444* (2013.01); *F01L 2013/001* (2013.01)

(58) Field of Classification Search
CPC ..... F01L 13/06; F01L 13/065; F01L 2001/2444; F01L 2013/001; F01L 2013/105; F01L 2305/00; F01L 2800/00
See application file for complete search history.

(56) References Cited

U.S. PATENT DOCUMENTS

| | | | | |
|---|---|---|---|---|
| 8,851,048 | B2 | 10/2014 | Meistrick | |
| 9,429,051 | B2 * | 8/2016 | Meneely | F02D 13/04 |
| 10,465,567 | B2 | 11/2019 | Nielsen | |
| 11,859,519 | B2 * | 1/2024 | Sheren | F02D 13/04 |
| 12,146,427 | B2 * | 11/2024 | Ferrario | F01L 13/0005 |
| 12,163,447 | B2 * | 12/2024 | Mccarthy, Jr | F01L 1/181 |
| 2014/0251266 | A1 | 9/2014 | Emmons | |
| 2018/0283241 | A1 * | 10/2018 | Cecil | F01L 1/2422 |
| 2018/0371961 | A1 | 12/2018 | Bogdanski | |
| 2019/0277166 | A1 | 9/2019 | Malischewski | |
| 2020/0224559 | A1 | 7/2020 | Mccarthy | |
| 2022/0025790 | A1 * | 1/2022 | Cecur | F01L 13/06 |
| 2022/0307389 | A1 * | 9/2022 | Edke | F01L 13/065 |
| 2022/0307392 | A1 * | 9/2022 | Taylor | F01L 1/267 |

* cited by examiner

ENGINE BRAKE HYDRAULIC CAPSULE WITH PLUNGER RETURN MECHANISM

PRIORITY

This application claims the benefit under 35 U.S.C. § 365 (c) of International Patent Application No. PCT/IB2024/052278, filed 8 Mar. 2024, which claims the benefit under 35 U.S.C. § 119 (a) of India patent application No. 202311015575, filed 9 Mar. 2023, which are incorporated herein by reference.

FIELD

The present disclosure relates generally to engine braking and, more particularly, to an improved engine brake capsule that enables an integrated rocker arm of an internal combustion engine to selectively engage and disengage the engine's exhaust valves.

BACKGROUND

Compression engine brakes can be used as auxiliary brakes, in addition to wheel brakes. A compression engine braking system is arranged, when activated, to provide an additional opening of an engine cylinder's exhaust valves when the piston in that cylinder is near a top-dead-center position of its compression stroke so that compressed air can be released through the exhaust valve. This causes the engine to function as a power-consuming air compressor, which slows the vehicle.

In a typical valve train assembly used with a compression engine brake, the exhaust valves associated with a cylinder are actuated by an integrated rocker arm which engages the exhaust valve by means of a valve bridge. The exhaust valves associated with a cylinder include a non-braking exhaust valve and a braking exhaust valve. The integrated rocker arm has a cam end, which is in contact with a cam, and a valve end, which has contact points that transfer the downward and upward motion of the rocker arm's valve end to one or more of the exhaust valves. The downward motion of the rocker arm's valve end is transferred to the valve bridge via a footing or connector, which in turn presses down on the exhaust valves to open them.

The integrated rocker arm is capable of selectively enabling different valve lift profiles to support drive mode and engine-brake mode. Such an integrated rocker arm may include a hydraulic capsule capable of extending and retracting a plunger based on hydraulic pressure. An extended plunger is able to engage the engine-braking exhaust valve, whereas a retracted plunger is not. When engine braking is desired, the plunger may extend to influence the open-and-close timing profile of the engine-braking exhaust valve without actuation of the entire valve bridge or the non-braking exhaust valve.

Certain conventional hydraulic capsules have a hydraulic actuation portion and a plunger portion arranged vertically in the same assembly. The dimensions of such a capsule could exceed the available space in certain engine platforms. Further, existing hydraulic capsules lack the flexibility to accommodate different coupling requirements for securing the capsule to the rocker arm (e.g., size of the nut and/or torque required to tighten and secure the nut). In addition, certain engine platforms may have significant inertia from the movement of the rocker arm and/or valves, which means a larger, bulkier lost motion spring is needed to absorb the inertia. Yet another shortcoming of existing solutions is that when an engine switches from engine braking mode to drive mode, the plunger component does not have a mechanism to return and stay in the retracted state. As such, there is a need for an improved engine brake mechanism.

SUMMARY

In some aspects, the techniques described herein relate to a rocker assembly, including: a rocker arm including a cam end, a center pivot bore, and a valve end, the valve end including a first bore; and an engine brake actuator including: an engine brake mechanism disposed within the first bore, the engine brake mechanism including a body and a plunger disposed within the body, wherein: the plunger is configured to translate between a retracted position and an extended position, the plunger contains a spring disposed between latch pins, the spring being configured to bias the latch pins in an outward direction, and the body defines seats for receiving the latch pins; and an actuation mechanism disposed within a second bore and configured to direct a fluid to the engine brake mechanism to hydraulically move the plunger to the extended position and hydraulically move the latch pins toward each other.

In some aspects, the techniques described herein relate to a rocker assembly, wherein the second bore is perpendicular to the first bore and parallel to the center pivot bore.

In some aspects, the techniques described herein relate to a rocker assembly, wherein the latch pins include shoulders that are configured to rest against the seats when the plunger is in the retracted position.

In some aspects, the techniques described herein relate to a rocker assembly, wherein the body of the engine brake mechanism is threadedly inserted into the first bore.

In some aspects, the techniques described herein relate to a rocker assembly, wherein a bottom of the body is open-ended and the plunger is configured to translate and extend out from the body through the open-ended bottom to engage an exhaust valve.

In some aspects, the techniques described herein relate to a rocker assembly, wherein the plunger includes a shoulder, wherein the shoulder is configured to abut against a first clip disposed along an interior of the body when the plunger is in the extended position.

In some aspects, the techniques described herein relate to a rocker assembly, further including a pathway fluidly coupling a first chamber of the actuation mechanism to the engine brake mechanism.

In some aspects, the techniques described herein relate to a rocker assembly, wherein the actuation mechanism includes (a) a second chamber configured to receive fluid from an oil control valve and (b) a check ball valve separating the second chamber from the first chamber, wherein fluid is configured to flow from the second chamber to the first chamber through the check ball valve when a checkball of the check ball valve is unseated by hydraulic pressure of the fluid.

In some aspects, the techniques described herein relate to a rocker assembly, further including a third bore disposed at the valve end of the rocker arm, wherein a cylinder deactivation actuator is secured therein, wherein the cylinder deactivation actuator is configured to actuate a valve bridge.

In some aspects, the techniques described herein relate to a valve assembly, including: the rocker assembly; the valve bridge; a first valve operatively coupled to the valve bridge; and a second valve operatively coupled to the valve bridge, wherein the cylinder deactivation actuator is configured to impart a main lift function to the first valve and to the second valve via the valve bridge.

In some aspects, the techniques described herein relate to a valve assembly, including: the rocker assembly; a valve bridge; a first valve operatively coupled to the valve bridge; and a second valve operatively coupled to the valve bridge, wherein the engine brake actuator is configured to impart an engine braking function to the second valve when the plunger is in the extended position.

In some aspects, the techniques described herein relate to a method of performing an engine braking function to a valve, including: introducing a fluid into a first chamber of an actuation mechanism disposed within a rocker arm, the actuation mechanism having a second chamber separated from the first chamber by a check ball valve; causing the fluid to flow from the first chamber into the second chamber through the check ball valve; causing the fluid in the second chamber to flow into an engine brake mechanism, via a pathway fluidly coupling the actuation mechanism to the engine brake mechanism, to (a) apply a compressive force against latch pins contained within the engine brake mechanism and (b) apply a translative force against a plunger; and translating the plunger in a downwards direction to extend the plunger out from an open-ended bottom of a body housing the plunger; and applying a force to the valve by the extended plunger.

In some aspects, the techniques described herein relate to a method, further including: ceasing to introduce fluid into the first chamber of the actuation mechanism to cause a reduction in hydraulic pressure within the engine brake mechanism, wherein the reduction in the hydraulic pressure allows a biasing force exerted by a spring against the latch pins to overcome the hydraulic pressure.

In some aspects, the techniques described herein relate to a method, further including: applying a force to the plunger to cause the plunger to translate in an upwards direction within the body of the plunger; and latching the plunger against seats defined within the body of the plunger as the latch pins extend outward into the seats by the biasing force exerted by the spring.

In some aspects, the techniques described herein relate to a method, wherein the force applied to the plunger to cause the plunger to translate in the upwards direction is caused by a contact between the plunger and the valve.

In some aspects, the techniques described herein relate to a rocker assembly, including: a rocker arm including a cam end, a center pivot bore, and a valve end, the valve end including a first bore; and an engine brake actuator including: an engine brake mechanism disposed within the first bore, the engine brake mechanism including a body and a plunger disposed within the body, wherein: the plunger is configured to translate between a retracted position and an extended position, the plunger contains latch pins configured to translate outwards and inwards, and the body defines seats for receiving the latch pins when the latch pins translate outward.

In some aspects, the techniques described herein relate to a rocker assembly, wherein a translation of the latch pins is electrically or mechanically controlled.

In some aspects, the techniques described herein relate to a rocker assembly, wherein the latch pins translate outwards when the rocker assembly is operating in a drive mode.

In some aspects, the techniques described herein relate to a rocker assembly, wherein the latch pins translate inwards when the rocker assembly is operating in an engine brake mode.

In some aspects, the techniques described herein relate to a rocker assembly, further including a second bore disposed at the valve end of the rocker arm, wherein a cylinder deactivation actuator is secured therein, wherein the cylinder deactivation actuator is configured to actuate a valve bridge.

BRIEF DESCRIPTION OF THE DRAWINGS

The following figures are included to illustrate certain aspects of the present disclosure and should not be viewed as exclusive embodiments. The subject matter disclosed is capable of considerable modifications alterations combinations, and equivalents in form and function, without departing from the scope of this disclosure.

DETAILED DESCRIPTION

Figure 1:
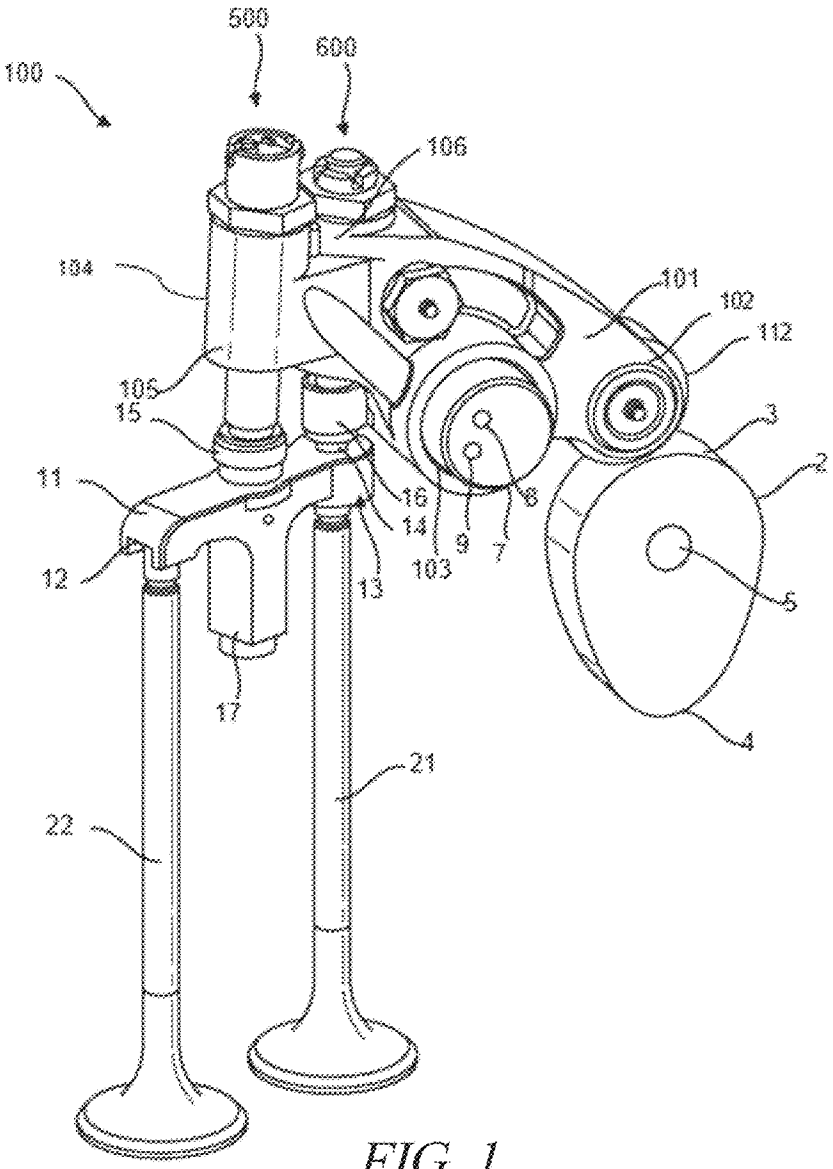
FIG. 1 illustrates a valve actuation assembly including a rocker assembly, according to one or more aspects of the present disclosure.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "1" and any one of which may be referred to generically as a widget "1". In the figures and the description, like numerals are intended to represent like elements.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

To facilitate a better understanding of the present disclosure, the following examples of certain embodiments are given. In no way should the following examples be read to limit, or define, the scope of the disclosure. Embodiments described below with respect to one implementation are not intended to be limiting.

The present disclosure may provide an improved engine brake actuator comprising of an engine brake mechanism controlled by an actuation mechanism. The engine brake mechanism has a plunger capable of selectively engaging one or more engine valves, and the actuation mechanism is capable of causing the engine brake mechanism to switch between an activated position (for normal drive mode) and an inactivated position (when engine braking is desired). As previously discussed, certain existing engine brake actuators embodied as a single capsule with an integrated engine brake mechanism and actuation mechanism have certain drawbacks that are unsuitable for certain engine platforms. The present disclosure addresses those challenges by providing an engine brake actuator in which the engine brake mechanism and the actuation mechanism are embodied as separate capsules disposed in separate bores in the rocker arm. Separating these components allows for a reduction in the size and/or height requirements in their respective areas, thereby accommodating engine platforms with particular space constraints. In addition, the engine brake mechanism, being a separate component with reduced size and/or height, has the flexibility to accommodate different fasteners to secure the engine brake mechanism into its separate bore. For example, the size and/or torque profile of the fastener (e.g., a nut) could be selected depending on the available space of the engine platform, the platform's load/inertial profiles, and/or other system requirements. As will be further appreciated, the engine brake mechanism according to particular embodiments has a built-in mechanism to keep the plunger in a retracted/disengaged state when the engine switches back from engine-brake mode to drive mode.

FIG. 1 illustrates a rocker assembly 100. The rocker assembly 100 may comprise a rocker arm 101, which comprises a cam end 102, a center pivot bore 103, and a valve end 104. The cam end 102 may comprise a roller 112 or another tappet, such as a slider pad. The valve end 104 may comprise a first bore 105 and a second bore 106. A cylinder deactivation actuator 500 may be disposed within the first bore 105. An engine brake actuator 600 may be disposed within the second bore 106. As will be further described below, particular embodiments of the engine brake actuator 600 may be separated into an engine brake mechanism and an actuation mechanism. The engine brake mechanism of the engine brake actuator 600 may be disposed within the second bore 106, and the actuation mechanism of the engine brake actuator 600 may be disposed within another bore at a different location, as will be described in further detail below. The orientation of the bore in which the actuation mechanism is dispose may vary depending on spatial constraints (e.g., its longitudinal axis may be horizontal or placed at any angle depending on packaging and manufacturing feasibility). Stated more generally, the actuation mechanism and the engine brake mechanism may have different longitudinal axis.

The rocker assembly 100 may be part of a valve assembly that can be distributed on a valvetrain to impart an engine braking function, a cylinder deactivation function, and/or a main lift function to corresponding first and second valves 21, 22 in the valvetrain 1. It may be further possible to impart an early exhaust valve opening ("EEVO") function, a main lift function, and a late exhaust valve closing ("LEVC") function to the designated engine braking valve. For example, the rocker assembly 100 may impart main lift function to the valves 21, 22 by a valve bridge as by control of the cylinder deactivation actuator 500.

In embodiments, an engine system may comprise several cylinders for combustion. The cylinders may be acted upon by the valvetrain that may comprise respective intake valves and respective first and second exhaust valves 21, 22, duplicated as necessary for each cylinder. At least one of the cylinders may comprise the valvetrain components shown in FIG. 1. Other cylinders can comprise rocker arms that are configured differently to give the engine system more optional functions. A cam 2 on a rotatable cam rail 5 may rotate a base circle lobe profile 3 and a lift lobe profile 4 against the roller 112 on the cam end 102 to actuate the valves 21, 22 at the valve end 104 of the rocker arm 101. The valves 21, 22 may comprise customary features such as a head and a stem and various accompaniments can be included such as return springs and guides.

The valve end 104 may be configured to act on a valve bridge 11, as by footings 15, 16. Second valve 21 may be connected to a cleat 14 in a pass-through 13 in the valve bridge 11. The engine brake function may be imparted to the second valve 21 by moving the cleat 14 separately from the rest of the valve bridge 11. A second valve 22 may be seated on a seat 12 of the valve bridge 11. When the whole valve bridge 11 is acted on, the second valve 22 may receive a main lift function and the valve bridge 11 may press the cleat 14 to impart the main lift function to the second valve 21. An optional guide 17 may be included on the valve bridge 11 with a corresponding alignment feature on the cylinder head of an engine.

Figure 2:
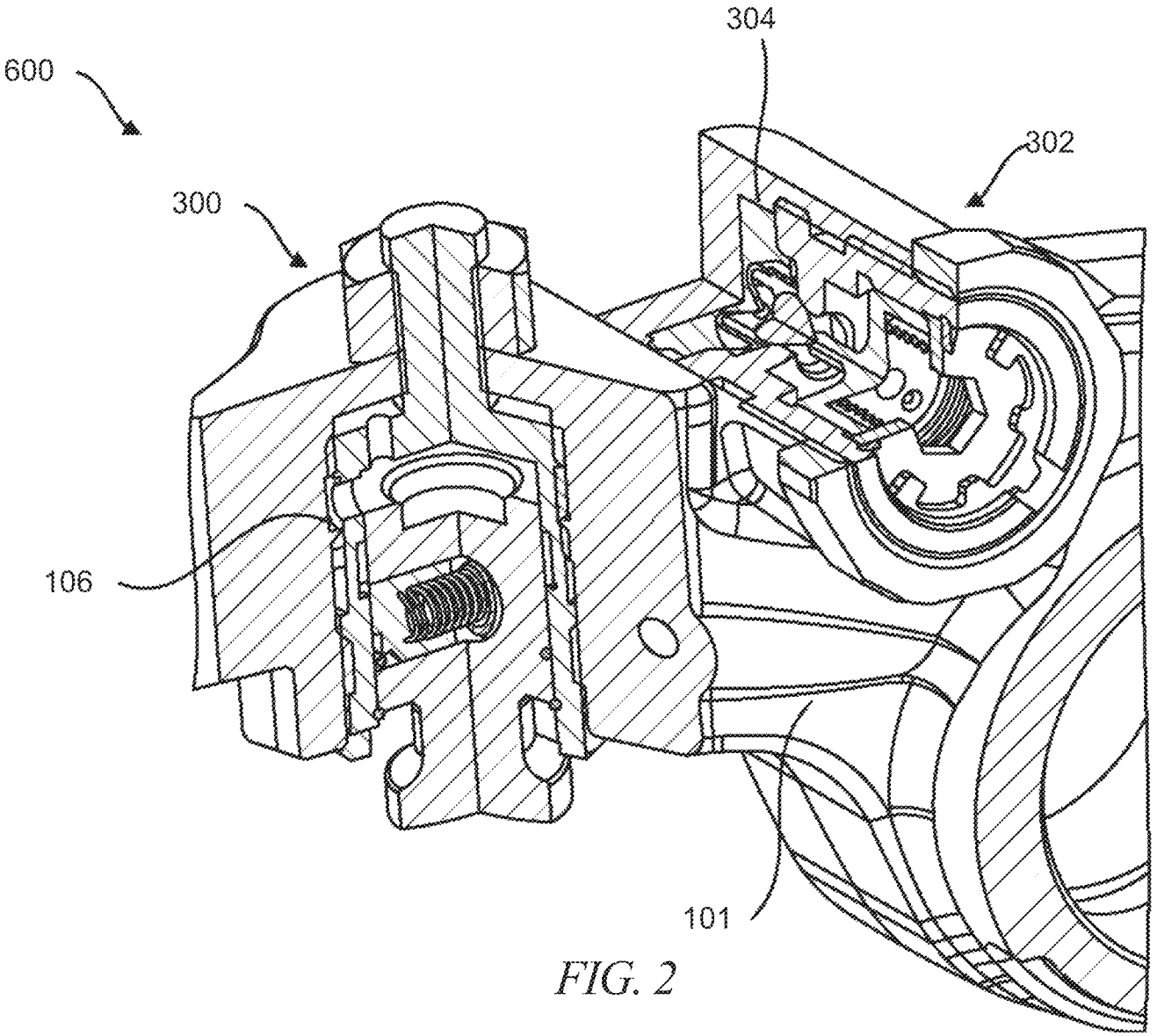
FIG. 2 illustrates a cross-sectional view of an engine brake actuator of the rocker assembly of FIG. 1, according to one or more aspects of the present disclosure.

FIG. 2 illustrates a perspective view of the engine brake actuator 600 of the rocker assembly 100, according to particular embodiments. Engine brake actuator 600 may comprise an engine brake mechanism 300 and an actuation mechanism 302, embodied in separate components with different longitudinal axes. For example, rather than being embodied in a single capsule, the engine brake mechanism 300 may be embodied in one capsule, and the actuation mechanism 302 may be embodied in another capsule. As shown in FIG. 2, the engine brake mechanism 300 may be disposed within second bore 106 within the rocker arm 101 (e.g., the capture may be screwed into bore 106). The longitudinal axis of the engine brake mechanism 300's may be oriented vertically so that the engine brake mechanism 300 can engage with one or more engine valves. The specific placement and orientation of the engine brake mechanism 300 in the rocker arm 101 depends on the relative configuration between the rocker arm 101 and the valve assigned to the engine brake mechanism 300.

In particular embodiments, the actuation mechanism 302 may be configured to actuate and control operations of the engine brake mechanism 300. The actuation mechanism 302 may be disposed within a third bore 304 of the rocker arm 101 (e.g., the corresponding capsule may be screwed into the third bore 304). The third bore 304 and the actuation mechanism 302 may have any suitable orientation depending on packaging and/or manufacturing constraints. As previously stated, the actuation mechanism 302's longitudinal axis may be different than that of the engine brake mechanism 300. For example, as shown in FIG. 2, the actuation mechanism 302 may be disposed perpendicular relative to the engine brake mechanism 300 and parallel relative to the center pivot bore 103 of the rocker arm 101 (referring to FIG. 1). In other embodiments, the actuation mechanism 302 and the third bore 304 may be disposed at an angle in relation to the second bore 106. By decoupling the physical placement and orientation of the actuation mechanism 302 from the engine brake mechanism 300, the actuation mechanism 302 may be placed in a manner to fit within the spatial constraints of the engine platform.

The rocker assembly 100 may further comprise a first hydraulic port connecting the center pivot bore 103 to the first bore 105 in which the cylinder deactivation actuator 500 is disposed (referring to FIG. 1). The rocker arm assembly 100 may additionally or alternatively have a second hydraulic port connecting the center pivot bore 103 to the third bore 304 in which the actuation mechanism 302 is disposed (referring to FIG. 2). The first hydraulic port may fluidly couple to a first fluid pathway 9 in a rocker shaft 7, as shown in FIG. 1, which can in turn couple to a first oil control valve ("OCV") in a control circuit. The second hydraulic port may fluidly couple to a second fluid pathway 8 in the rocker shaft 7, as shown in FIG. 1, which can in turn couple to a second OCV in the control circuit. A rotation mechanism may be included to rotate the rocker shaft 7 to switch the first and second fluid pathways 9,8 in and out of alignment with their respective first and second hydraulic ports within the center pivot bore 103. Additional fluid pathways may be included in the rocker shaft 7, such as a return pathway. The first and second OCVs may be controlled to supply high pressure hydraulic fluid to switch the cylinder deactivation actuator 500 or engine brake actuator 600, as described below.

Figure 3:
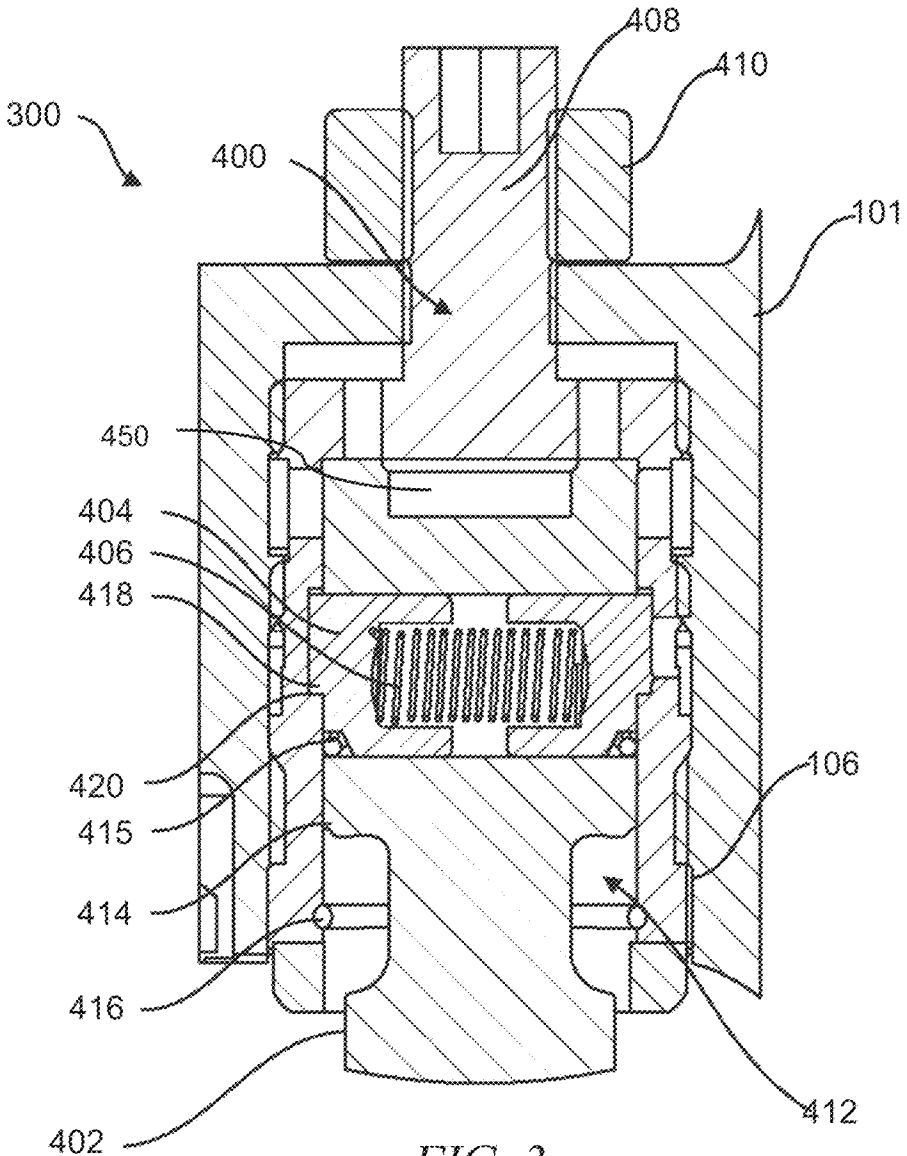
FIG. 3 illustrates a cross-section of an engine brake mechanism of the engine brake actuator of FIG. 2, according to one or more aspects of the present disclosure.

FIG. 3 illustrates a cross-section of the engine brake mechanism 300 with a plunger-return mechanism. The engine brake mechanism 300 of the engine brake actuator 600 may be configured to engage engine brake valve 21 (referring to FIG. 1). The engine brake mechanism 300 may be any suitable size, height, shape, and any combinations thereof. Further, the engine brake mechanism 300 may comprise any suitable materials, such as metals, nonmetals, polymers, composites, and any combinations thereof. The engine brake mechanism 300 may be embodied within a capsule housing and disposed within bore 106 of the rocker arm 101. The engine brake mechanism 300 may comprise a body 400, a plunger 402, one or more latch pins 404, and a spring 406 for biasing the latch pins 404. As illustrated, the body 400 may be inserted and secured into the second bore 106, wherein the body 400 may be threaded to the second bore 106. A stem 408 of the body 400 may extend upwards through the rocker arm 101 and out of a top of the rocker arm 101, wherein a bolt 410 (e.g., an M8 bolt or any other suitable bots) may be fastened to the stem 408. The body 400 may generally be cylindrical in shape, wherein the stem 408 is disposed at the top of the body 400, and a bottom of the body 400 is open-ended. The interior of the body 400 may define an internal chamber 412 configured to house the plunger 402.

The plunger 402 may be configured to translate along the central longitudinal axis of the body 400 within the internal chamber 412. In embodiments, the plunger 402 may extend out from the body 400 through the open-ended bottom, along the longitudinal axis. A distance the plunger 402 may be operable to travel may be defined by a shoulder 414 of the plunger 402 and a first clip 416 along the interior of the body 400 in the internal chamber 412. A second clip 415 may be disposed between the latch pins 404 and the interior of the body 400 to prevent movement and/or rotation of the latch pins 404, thereby ensuring that the latch pins 404 would remain aligned with corresponding seats on the interior surface of the body to receive the latch pins 404 when they're extended.

In embodiments, the engine brake mechanism 300 may be pressurized with a suitable fluid (e.g., oil) to actuate the plunger 402 to translate in a downwards direction towards the engine brake valve 21. As illustrated, the plunger 402 may house the latch pins 404 and spring 406. The spring 406 may be disposed between the latch pins 404 in order to bias the latch pins 404 outwards. In the absence of hydraulic pressure, the spring 406 may cause the latch pins 404 to extend outward. When the latch pins 404 are aligned with their corresponding seats 420 in the body 400, the latch pins 404 will at least partially extend outward past the plunger 402 and latch into the corresponding seats 420. In this configuration, shoulders 418 of latch pins 404 will rest above their corresponding seats 420 defined in the interior of the body 400, thereby preventing the plunger 402 from traveling further downward toward the engine brake valve 21. As will be discussed in more detail below, when the engine transitions from drive mode to engine-brake mode, the actuation mechanism 320 would inject hydraulic fluid into the engine brake mechanism 300. Pressure from the hydraulic fluid would exert force against the latch pins 404 and overcome the biasing-force of the spring 406, thereby causing the latch pins 404 to translate in an inward direction in relation to the plunger 402. In doing so, the latch pins 404 are unseated from seat 420 and may clear the outer circumferential surface of plunger 402, thereby freeing a direction of movement for the plunger 402. As hydraulic fluid enters chamber 450 and increases the pressure therein, the plunger 402, in the freed state, may be actuated in a downwards direction until the shoulder 414 abuts against first clip 416.

As described with reference to FIG. 4, the engine brake mechanism 300 may be pressurized by a suitable fluid, wherein the fluid exerts a hydraulic force against the latch pins 404. In certain other embodiments, the latch pins 404 may be actuated by a mechanical force, an electrical force, or a combination thereof. For example, the latch pins 404 may be controlled by a solenoid (not shown) operable to translate the latch pins 404 radially inward and outward based on electricity or some electrical signal. In another example, a separate mechanical component (not shown) may be actuated to push against the latch pins 404.

Figure 4C:
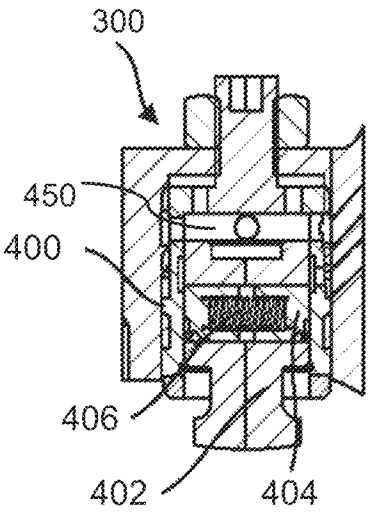
FIGS. 4A-4C illustrate cross-sectional views when actuating the engine brake actuator of FIG. 3, according to one or more aspects of the present disclosure.
Figure 4B:
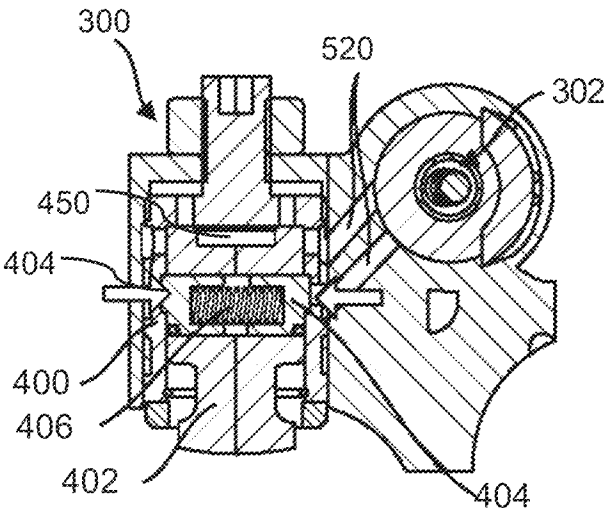
Figure 4A:
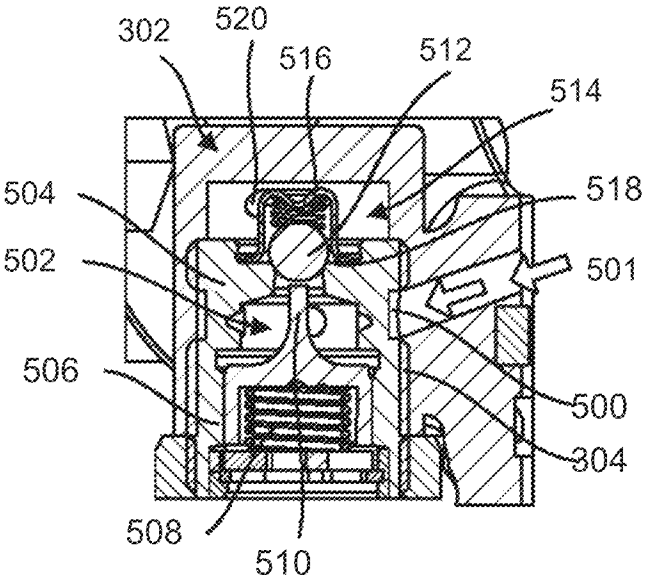

FIGS. 4A-4C illustrate cross-sections for actuating the engine brake actuator 600. FIG. 4A illustrated a cross-section of the actuation mechanism 302. FIG. 4B illustrates a cross-section of the engine brake mechanism 300 transitioning from the initial position (e.g., drive mode) to an actuated or secondary position (e.g., engine brake mode). FIG. 4C illustrates a cross-section of the engine brake mechanism 300 in the actuated position with the plunger 402 extended. In embodiments, an OCV may direct a fluid along a pathway to the actuation mechanism 302. The fluid may be introduced into the actuation mechanism 302 via an inlet 501, wherein the fluid is then directed into a first chamber 502 within a body 504 of the actuation mechanism 302. Similar to body 400, the body 504 of the actuation mechanism 302 may be threadedly secured within the third bore 304 (see also FIG. 2). The first chamber 502 may be defined by the interior of the body 504 and by a piston 506 biased by a spring 508 towards a checkball 512. The piston 506 comprises a stem 510 extending upwards operable to force the checkball 512 of a check ball valve to remain open absent sufficient hydraulic pressure in the first chamber 502, thereby fluidly coupling the first chamber 502 to a second chamber 514. The check ball valve may be disposed within the second chamber 514 and may comprise the ball 514 and a spring 516 operable to bias the ball 512 downwards towards the first chamber 502 and against a seat 518 defined at a surface of the body 504 facing the checkball 512.

In the absence of hydraulic pressure, the spring 508 may bias stem 510 of piston 506 toward the checkball 512 and force it off of seat 518 to open up a path between the first chamber 502 and second chamber 514. The second chamber 514 is fluidly coupled to the engine brake mechanism 300 via pathways 520, as shown in FIG. 4B. Thus, when the first chamber 502 and second chamber 514 in the actuation mechanism 302 are depressurized, the engine brake mechanism 300 will also be depressurized. As previously discussed, absent hydraulic pressure, the spring 406 will push the latch pins 404 outward, thereby causing them to latch. In the latched state, the plunger 402 would not be able to extend.

As fluid flows into first chamber 502 and pressurizes the first chamber 502, the piston 506 may be forced downwards to overcome the biasing force of the spring 508. In this state, the piston 506 is no longer engaging the checkball 512. Due to the spring 516, the checkball 512 may be biased against seat 518. However, the hydraulic pressure in the first chamber 502 would overcome the biasing force of the checkball 512 to allow fluid to flow into chamber 514. Fluid may then be directed out of the second chamber 514 through a pathway 520 coupling the second chamber 514 to the engine brake mechanism 300. As hydraulic pressure equalizes between the engine brake mechanism 300, the first chamber 502, and the second chamber 514, the spring 516 will bias the checkball 512 toward the seat 518, thereby closing the connection between the first chamber 502 and the second chamber 514. Since fluid in the engine brake mechanism cannot flow through the closed checkball valve, the pressure within the engine brake mechanism 300 is maintained.

As fluid flows through pathway 520 and into engine brake mechanism 300, the pressure may increase against the outer surface of the latch pins 404. For example, there may be a space or tolerance wherein the fluid is flowed to encounter the latch pins 404. The pressure increase may force the latch pins 404 radially inwards and compress the spring 406 (denoted by the inward arrows). Here, the shoulder 418 (referring to FIG. 3) may be unseated from seat 420 (referring to FIG. 3) of the body 400, and latch pins 404 may be displaced radially inward to clear the seat 420. Fluid flowing into chamber 450 on an opposing end of the plunger 402 causes pressure within the chamber 450 to increase. The pressure may apply a downward force upon the plunger 402 toward an opening where the engine break valve is located. As the latch pins 404 are no longer latched, the plunger 402 may translate downwards until abutting against the first clip 416 (referring to FIG. 4). This may be a brake mode, wherein the plunger 402 is extended (as shown in FIG. 4C) to encounter the engine brake valve 21 (referring to FIG. 1).

During operations, as the rocker arm 101 (referring to FIG. 1) is actuated, the plunger 402 may be displaced to apply a force onto the brake valve 21. In typical engine brake actuator systems, the load path of an opposing force applied onto the plunger during a brake mode may occur as follows: from the plunger to the interface securing the body of the combined engine brake actuator; and from said interface to the rocker arm. However, in the present embodiments, the load path of an opposing force applied onto the plunger during a brake mode may occur as follows: from the plunger 402 to a combination of the interface securing the body 400 of the engine brake mechanism 300 and the fluid pressure present within chamber 450 in the body 400; and from that combination to the rocker arm. The fluid pressure in the chamber 450 helps mitigate the load and reduces the wear and tear on the engine brake mechanism 300.

Figure 5B:
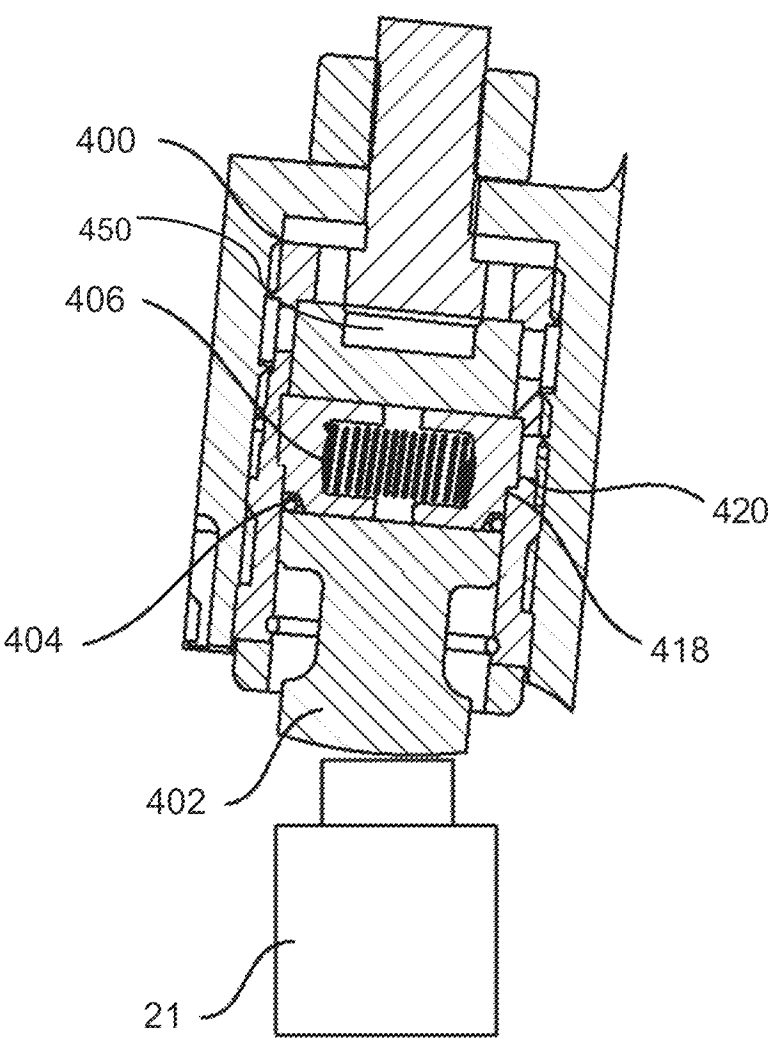
FIGS. 5A-5B illustrate cross-sections for retracting the engine brake mechanism of the engine brake actuator of FIG. 2 in a drive mode, according to one or more aspects of the present disclosure.
Figure 5A:
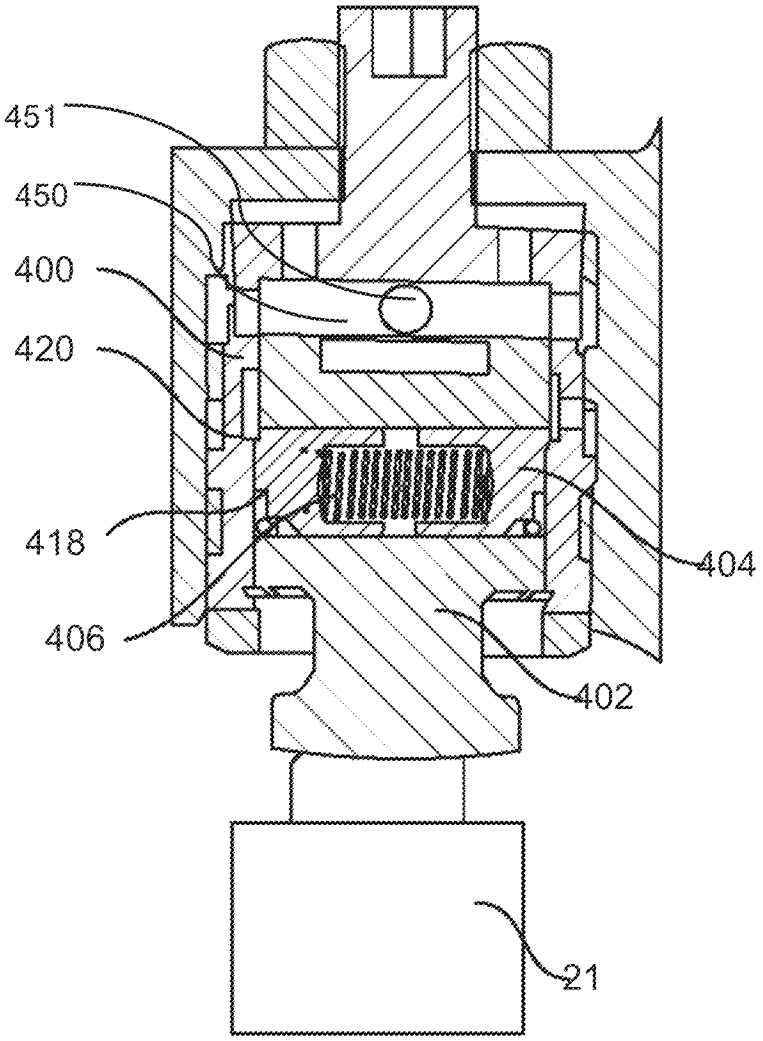

FIGS. 5A-5B illustrate cross-sections of the engine brake mechanism 300 when retracting the plunger 402 in the engine brake mechanism 300 of the engine brake actuator 600 (referring to FIG. 2). For example, when fluid pressure in engine brake mechanism 300 decreases as the engine transitions from engine brake mode to drive mode, the downward pressure exerted from chamber 450 upon plunger 402 may be reduced. In addition, when the fluid pressure exerted against latch pins 404 decreases below the biasing force of spring 406, the spring 406 would push the latch pins outward. As the plunger 402 encounters engine brake valve 21, a force may be applied upwards onto the plunger 402, wherein the plunger 402 may be retracted and translate back to an initial position. As the plunger 402 returns to the initial position at which the aforementioned seat 420 for the latch pins 404 is located, the latch pins 404, which are being biased outward by the spring 406, will cause the latch pins 404 to be displaced outward. The latch pins 404 may then rest against the body 400, and the shoulders 418 of the latch pins 404 returns to be seated against the seat 420.

FIG. 5B shows the plunger 402 having returned to the latched state. During this retraction process, as the plunger 402 translates back up through body 400, the upper portion of plunger 402 may apply force onto the remaining fluid present in the chamber 450, thereby directing the fluid back into the opening 451 of the pathways 520 (referring to FIG. 4B) towards actuation mechanism 302 (referring to FIG. 4A). Because the OCV may be turned off, the supply of fluid into first chamber 502 (referring to FIG. 4A) of actuation mechanism 302 may subsequently be stopped and the reduced pressure may not be sufficient to compress spring 508 (referring to FIG. 4A). In embodiments, the spring 508 may expand and force piston 506 upwards to unseat the checkball 512. At this time, the second chamber 514 (referring to FIG. 5A) may be in fluid communication with the first chamber 502, and the fluid received from engine brake mechanism 300 may flow from second chamber 514 into first chamber 502 and out towards the OCV.

Figure 6B:
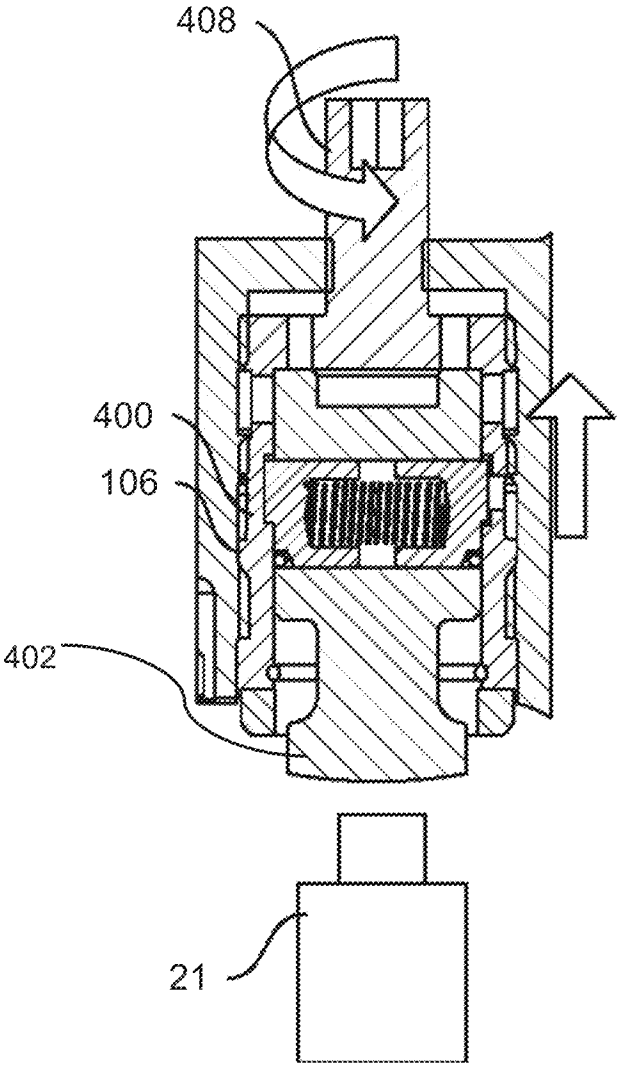
FIGS. 6A-6D illustrate cross-section views demonstrating a process for adjusting the lash of the engine brake mechanism of the engine brake actuator of FIG. 2, according to one or more aspects of the present disclosure.
Figure 6A:
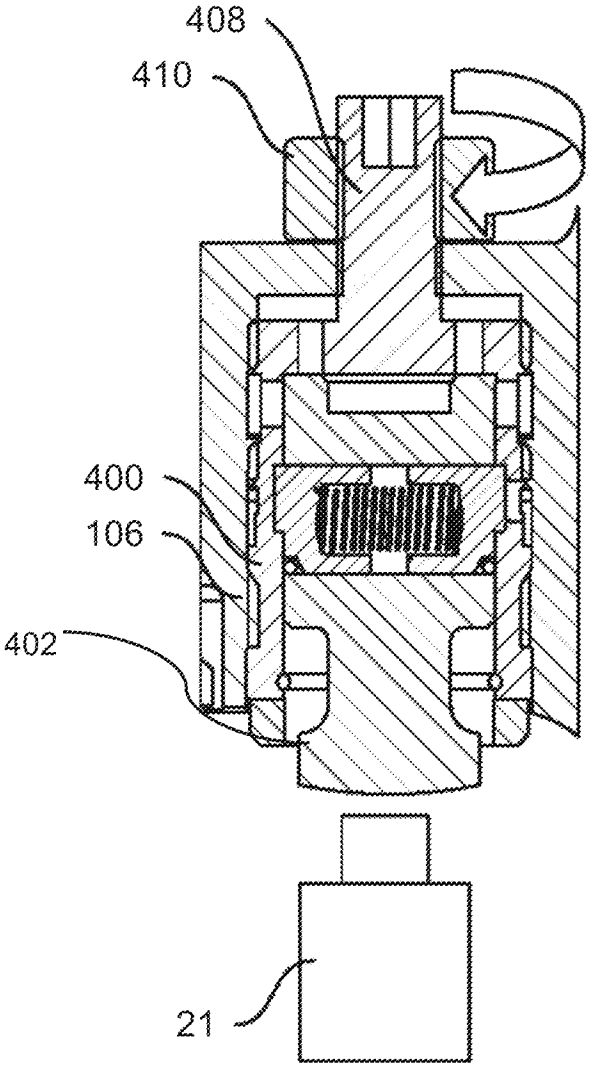
Figure 6D:
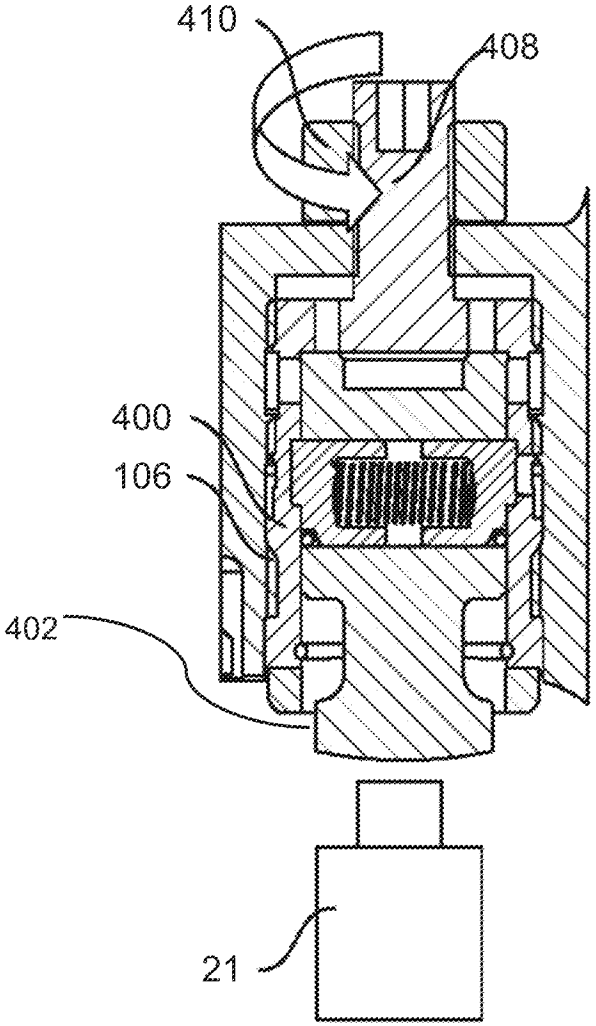
Figure 6C:
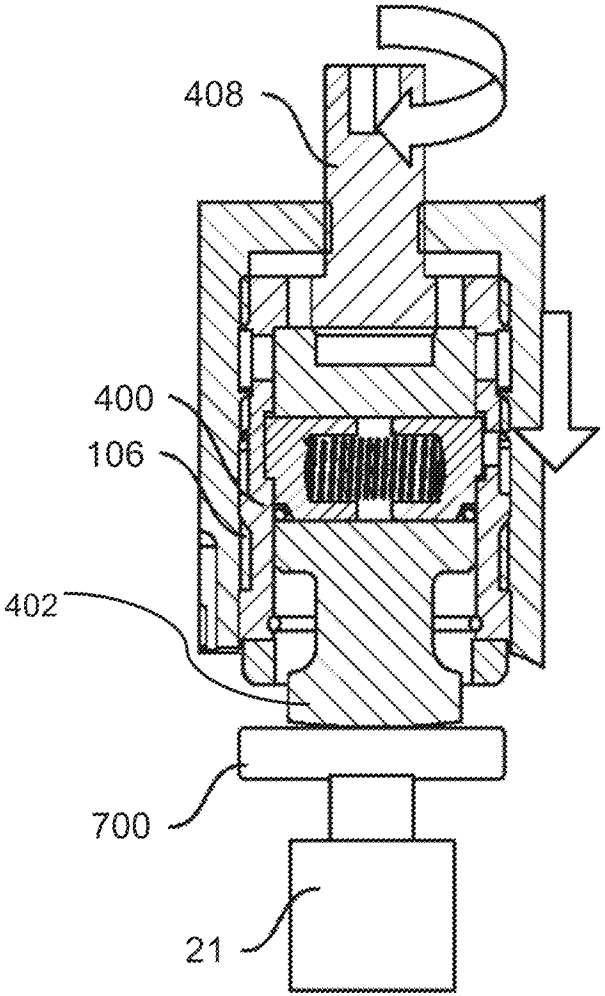

FIGS. 6A-6D illustrate cross-sections for lash setting the engine brake mechanism 300. To adjust the distance between an end of the plunger 402 (referring to FIG. 4) and the valve 21, a lash setting procedure may be performed. The bolt 410 securing the stem 408 of body 400 to the rocker arm 101 (referring to FIG. 1) may be loosened, as shown in FIG. 6A. The body 400 may then be rotated to traverse up or down the threads within second bore 106. Rotating body 400 may adjust the distance between the plunger 402 and the valve 21. FIG. 6B illustrates the plunger 402 moving upwards, away from the valve 21. Once there is sufficient clearance between the plunger 402 and the valve 21, a slip gauge 700 having a desired thickness may be inserted between the valve 21 and plunger 402. The body 400 may be rotated so as to force the plunger 402 against the slip gauge 700 as the slip gauge 700 rests on the valve 21, as shown in FIG. 6C. The slip gauge 700 may then be removed, and the bolt 410 may be tightened along the stem 408 to secure the placement of the body 400, as shown in FIG. 6D.

The present disclosure provides the practical applications of integrating a return mechanism for the engine brake actuator 600. The components of the engine brake actuator 600 may be split between separate bores, providing for a smaller height compared to conventional engine brake actuators. Separating these components may provide a reduced size and/or height in that respective area where a typical engine brake actuator would be located in a rocker arm, and such a reduction may be beneficial to packaging. In addition, the reduction in size and/or height may increase the availability of potential fasteners used to secure the engine brake mechanism into its separate bore. For example, the smaller size may require less torque and/or a smaller fastener for securing the engine brake mechanism when compared to a larger combined engine brake mechanism and actuation mechanism. Further, the present disclosure provides an engine brake mechanism 300 configured to be actuated by any suitable external force. While the present figures illustrated an embodiment for hydraulic pressurization, the present disclosure is not so limited and provides for any suitable mechanical forces, electrical forces, or combinations thereof.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

The invention claimed is:

1. A rocker assembly, comprising:

a rocker arm comprising a cam end, a center pivot bore, and a valve end, the valve end comprising a first bore; and an engine brake actuator comprising:

an engine brake mechanism disposed within the first bore, the engine brake mechanism comprising a body and a plunger disposed within the body, wherein:

the plunger is configured to translate between a retracted position and an extended position, the plunger contains a spring disposed between latch pins, the spring being configured to bias the latch pins in an outward direction, and the body defines seats for receiving the latch pins; and an actuation mechanism disposed within a second bore and configured to direct a fluid to the engine brake mechanism to hydraulically move the plunger to the extended position and hydraulically move the latch pins toward each other.

2. The rocker assembly of claim 1, wherein the second bore is perpendicular to the first bore and parallel to the center pivot bore.

3. The rocker assembly of claim 1, wherein the latch pins comprise shoulders that are configured to rest against the seats when the plunger is in the retracted position.

4. The rocker assembly of claim 1, wherein the body of the engine brake mechanism is threadedly inserted into the first bore.

5. The rocker assembly of claim 1, wherein a bottom of the body is open-ended and the plunger is configured to translate and extend out from the body through the open-ended bottom to engage an exhaust valve.

6. The rocker assembly of claim 1, wherein the plunger comprises a shoulder, wherein the shoulder is configured to abut against a first clip disposed along an interior of the body when the plunger is in the extended position.

7. The rocker assembly of claim 1, further comprising a pathway fluidly coupling a first chamber of the actuation mechanism to the engine brake mechanism.

8. The rocker assembly of claim 7, wherein the actuation mechanism comprises (a) a second chamber configured to receive fluid from an oil control valve and (b) a check ball valve separating the second chamber from the first chamber, wherein fluid is configured to flow from the second chamber to the first chamber through the check ball valve when a checkball of the check ball valve is unseated by hydraulic pressure of the fluid.

9. The rocker assembly of claim 1, further comprising a third bore disposed at the valve end of the rocker arm, wherein a cylinder deactivation actuator is secured therein, wherein the cylinder deactivation actuator is configured to actuate a valve bridge.

10. A method of performing an engine braking function to a valve, comprising:

introducing a fluid into a first chamber of an actuation mechanism disposed within a rocker arm, the actuation mechanism having a second chamber separated from the first chamber by a check ball valve;

causing the fluid to flow from the first chamber into the second chamber through the check ball valve;

causing the fluid in the second chamber to flow into an engine brake mechanism, via a pathway fluidly coupling the actuation mechanism to the engine brake mechanism, to (a) apply a compressive force against latch pins contained within the engine brake mechanism and (b) apply a translative force against a plunger; and translating the plunger in a downwards direction to extend the plunger out from an open- ended bottom of a body housing the plunger; and applying a force to the valve by the extended plunger.

11. The method of claim 10, further comprising:

ceasing to introduce fluid into the first chamber of the actuation mechanism to cause a reduction in hydraulic pressure within the engine brake mechanism, wherein the reduction in the hydraulic pressure allows a biasing force exerted by a spring against the latch pins to overcome the hydraulic pressure.

12. The method of claim 11, further comprising:

applying a force to the plunger to cause the plunger to translate in an upwards direction within the body of the plunger; and latching the plunger against seats defined within the body of the plunger as the latch pins extend outward into the seats by the biasing force exerted by the spring.

13. The method of claim 12, wherein the force applied to the plunger to cause the plunger to translate in the upwards direction is caused by a contact between the plunger and the valve.

14. A rocker assembly, comprising:

a rocker arm comprising a cam end, a center pivot bore, and a valve end, the valve end comprising a first bore; and an engine brake actuator comprising:

an engine brake mechanism disposed within the first bore, the engine brake mechanism comprising a body and a plunger disposed within the body, wherein:

the plunger is configured to translate between a retracted position and an extended position, the plunger contains one or more latch pins configured to translate outwards and inwards, and the body defines corresponding seats for receiving the one or more latch pins when the one or more latch pins translate outward, wherein the one or more latch pins translate (i) outwards when the rocker assembly is operating in a drive mode, or (ii) inwards when the rocker assembly is operating in an engine brake mode.

15. The rocker assembly of claim 14, wherein a translation of the one or more latch pins is electrically or mechanically controlled.

16. The rocker assembly of claim 14, wherein the one or more latch pins translate outwards when the rocker assembly is operating in the drive mode and inwards when the rocker assembly is operating in the engine brake mode.

17. The rocker assembly of claim 14, further comprising a second bore disposed at the valve end of the rocker arm, wherein a cylinder deactivation actuator is secured therein, wherein the cylinder deactivation actuator is configured to actuate a valve bridge.

* * * * *